US012302960B2

(12) United States Patent
Schaaper

(10) Patent No.: US 12,302,960 B2
(45) Date of Patent: May 20, 2025

(54) BODY PART PAD

(71) Applicant: INMARKET B.V., Delft (NL)

(72) Inventor: Martijn Schaaper, Monster (NL)

(73) Assignee: INMARKET B.V., Delft (NL)

( * ) Notice: Subject to any disclaimer, the term of this patent is extended or adjusted under 35 U.S.C. 154(b) by 73 days.

(21) Appl. No.: 17/907,226

(22) PCT Filed: Mar. 25, 2021

(86) PCT No.: PCT/NL2021/050198
§ 371 (c)(1),
(2) Date: Sep. 23, 2022

(87) PCT Pub. No.: WO2021/194342
PCT Pub. Date: Sep. 30, 2021

(65) Prior Publication Data

US 2023/0120562 A1 Apr. 20, 2023

(30) Foreign Application Priority Data

Mar. 26, 2020 (NL) ..... 2025213

(51) Int. Cl.
*A41D 13/06* (2006.01)
*A41D 13/05* (2006.01)
*A41D 13/08* (2006.01)

(52) U.S. Cl.
CPC ..... *A41D 13/065* (2013.01); *A41D 13/0512* (2013.01); *A41D 13/08* (2013.01)

(58) Field of Classification Search
CPC ... A41D 13/065; A41D 13/08; A41D 13/0512
(Continued)

(56) References Cited

U.S. PATENT DOCUMENTS 3,153,792 A 10/1964 Marietta
3,772,704 A * 11/1973 Carbonneau ..... A63B 71/1225 2/22

(Continued)

FOREIGN PATENT DOCUMENTS

DE 381831 C 9/1923
EP 2 283 738 A1 2/2011

(Continued)

OTHER PUBLICATIONS

Van Voorst "International Search Report" for parent Application No. PCT/NL2021/050198; mailed Apr. 15, 2021; six pages.

(Continued)

*Primary Examiner* — Timothy K Trieu
(74) *Attorney, Agent, or Firm* — Studebaker Brackett PLLC

(57) ABSTRACT

Body part pad for protecting a double curved body part from external load. The body part pad comprises a flexible carrying dish which in a first bending direction is bendable about a first bending axis and which in a second bending direction is bendable about a second bending axis. The carrying dish comprises a multiplicity of segments of which adjacent segment parts are disposed with an intermediate distance. The intermediate distance of adjacent segment parts is variable upon bending of the carrying dish at least in the second bending direction, so that, in use, a force that is exerted by the body part on the carrying dish and the opposed forces that are exerted on the carrying dish result in curvature of the carrying dish around the first and second bending axis to a curvature corresponding more with the body part to be protected.

23 Claims, 5 Drawing Sheets

(58) Field of Classification Search
USPC ..... 2/459
See application file for complete search history.

(56) References Cited

U.S. PATENT DOCUMENTS

| | | | | |
|---|---|---|---|---|
| 5,711,028 | A * | 1/1998 | Bourque | A63B 71/1225 2/22 |
| 7,376,978 | B2 * | 5/2008 | Godshaw | A41D 13/0568 2/24 |
| 7,937,768 | B2 * | 5/2011 | Behrend | A63B 71/1225 2/24 |
| 8,931,119 | B2 * | 1/2015 | Gordon | A41D 13/015 2/455 |
| 9,622,518 | B2 * | 4/2017 | Wright | A41D 13/0015 |
| 2004/0111782 | A1 * | 6/2004 | Lenormand | A41D 13/05 2/69 |
| 2008/0072359 | A1 * | 3/2008 | Godshaw | A41D 13/00 2/24 |
| 2009/0126066 | A1 * | 5/2009 | Sasaki | A41D 13/065 2/24 |
| 2012/0030850 | A1 * | 2/2012 | Wood | A47C 16/02 2/24 |
| 2013/0145514 | A1 * | 6/2013 | Noble | A41D 13/065 2/24 |
| 2013/0232674 | A1 * | 9/2013 | Behrend | A41D 13/0543 2/455 |
| 2013/0269075 | A1 | 10/2013 | Boye | |
| 2014/0359912 | A1 * | 12/2014 | Sutton | A41D 13/015 2/24 |
| 2018/0162615 | A1 * | 6/2018 | Hansen | B65D 65/38 |

FOREIGN PATENT DOCUMENTS

| | | | |
|---|---|---|---|
| JP | S63-92703 | A | 4/1988 |
| KR | 10-2018-0126267 | A | 11/2018 |
| WO | 2012/021737 | A1 | 2/2012 |

OTHER PUBLICATIONS

Van Voorst "Written Opinion of the International Searching Authority" for parent Application No. PCT/NL2021/050198; mailed Apr. 15, 2021; five pages.

* cited by examiner

BODY PART PAD

The invention relates to a body part pad for protecting a double curved body part from external load.

BACKGROUND

Exerting an external force on a body part results in a pressure on this body part. When this pressure concentrates in a sensitive body part, this may cause pain, irritation or other complaints. An example is the pressure on a knee joint. When someone kneels on a surface, this person's weight rests partly or wholly on his/her knees, and the surface exerts an equally great, opposed force on the parts of the knee that contact the surface. The small size of these parts leads to a high peak load. Especially when this peak load localizes in weak parts, such as the patella, bursa, and/or joint space, prolonged maintaining of such a kneeled position can lead to knee complaints.

Another example is the pressure on a shoulder. When a carrying bag with carrying strap is slipped on a shoulder, this results in the shoulder having a high peak load at the location of the strap, which can lead to shoulder pain.

For alleviation of the knee complaints and for protection of the knee joint, solutions in the form of knee pads are known. A knee pad is a device that distributes an external force over a larger surface and thereby prevents a high peak load on a part of the joint. In broad outline, two kinds of knee pads can be distinguished: external knee pads, which can be worn over the trousers, and internal knee pads which can be placed in knee pockets of an already made pair of trousers. Also, external knee pads may be placed on the ground as mats.

External knee pads are typically larger and heavier than internal knee pads and they are typically tied around a user's leg. An example of an external knee pad is DE 381 831 C. There is shown a knee pad provided with a cap-like knee plate which is supported by a spring and rubber jacket. The cap-like knee plate has its center cut open, with discrete lugs thereby formed. In use, the knee plate is depressed by the user's knee and the lugs enhance the elasticity of the knee plate.

Another example of an external knee pad is NL 1032913. There is shown a knee pad which is curved around a longitudinal axis, which is parallel to the leg. The knee pad is provided with a nose part which in kneeled condition protects a front part of a user's knee. The knee pad spreads the opposed force evenly over a large surface, so that no peak load is involved. Such a knee pad is comfortable in kneeling condition. In extended condition of the leg, the relatively large and heavy knee pad tied to the leg is experienced as uncomfortable. Further, it is also due to the nose part that the knee pad, in the extended condition of the leg, does not sit on the leg comfortably.

Because internal knee pads have to fit into a knee pocket, they are typically more compact and also lighter than external knee pads. They generally consist of a foam cushion which is folded around the knee. All of this is seen as comfortable, especially during walking or sitting. Internal pads, however, have a lesser thickness than external pads. This limited thickness makes it more difficult for internal knee pads to generate an optimum pressure profile. Also, the foam layer used, if subject to prolonged full loading, will compress and harden, as a result of which the peak load on some parts of the knee will increase. Because of this, the internal pads, in kneeling position, are experienced as less comfortable than external knee pads.

SUMMARY OF THE INVENTION

It appears from the foregoing that on the one hand there are knee pads that are comfortable in loaded use, that is, kneeling, and not in unloaded use, that is, sitting or walking. On the other hand there are knee pads that are comfortable in unloaded use, but not in loaded use. In the market, however, the need exists for a body part pad, for example a knee pad, which is comfortable both in unloaded user position and in loaded user position. In the example of the knee pad, this means that it is comfortable for the user when walking and sitting, as well as when kneeling.

The object of the invention is to provide a body part pad that not only is comfortable in unloaded use but also provides a proper pressure distribution in loaded use.

The invention to that end provides a body part pad for protecting a double curved body part from external load according to claim 1. More particularly, the invention provides a body part pad comprising a flexible carrying dish, which in a first bending direction is bendable about a first bending axis, and which in a second bending direction is bendable about a second bending axis. The carrying dish comprises a multiplicity of segments of which adjacent segment parts are disposed with an intermediate distance. The intermediate distance of adjacent segment parts upon bending of the carrying dish is variable, at least in the second bending direction, so that, in use, a force that is exerted on the carrying dish by the body part and the opposed forces that are exerted on the carrying dish result in curvature of the carrying dish around the first and second bending axis to a curvature more corresponding with the body part to be protected.

An aspect of the invention is the insight that the existing external knee pads are good at curving the knee pad around the longitudinal direction of the leg. However, if the knee is extended or bent to take up a kneeling position, it also bends in another bending direction, namely transversely with respect to the leg, in the knee joint itself. This makes the knee a double curved body part. Other examples of double curve body parts are the shoulder, the elbow, and the heel. The existing body part pads are good at conforming to the supported body part around one axis. However, they are not suitable, or less so, for protecting double curved body parts.

The body part pad according to the invention may be implemented as a bowl-shaped body part pad for protecting a bowl-shaped body part, such as a knee pad, shoulder pad, elbow pad, and/or a heel pad. A bowl-shaped body part is a double curved body part where both curvatures are oriented the same, that is, both curvatures face the same way. Due to the body part pad being better able to conform around the double curved body part to be protected, it is better able to spread the opposed forces, resulting from the external load, evenly over a larger surface than was possible previously. The peak load on one or a few points on the body part decreases as a result. The first bending direction can for instance correspond to the curvature around the longitudinal axis of a leg at the location of a knee. The bendability in the second bending direction then ensures that the body part pad both with an extended leg and with a bent knee properly adjoins the knee. This means that the body part pad, if implemented as a knee pad, is comfortable both in unloaded use, such as sitting or standing, and in loaded use, that is, kneeling. The segments provide the necessary flexibility for the carrying dish to be able to perform both bending acts. It is not requisite, however, that segments be used for this. Any implementation of the carrying dish that is sufficiently flexible to curve around the body part to be protected, suffices.

An interspace between the adjacent segment parts can be free. The segments may be substantially single curved. That is to say they have a curvature that lies in one plane. Such a curvature makes it easier for the carrying dish to curve parallel to that plane. Ends of these single curved segments may be flattened. The segments may be implemented as substantially flat and elongate segments. The segments may also be elastic.

The segments may be connected to each other by or near a central portion or end. The segments may be disposed next to and parallel to each other and substantially parallel to the second bending axis. Two successive segments may be connected by means of a connecting element, for instance near the central portion or near the ends. The connecting element may for instance provide for pivoting of the connecting elements relative to each other. This pivoting may then be realized about one or more axes, for example about axes in the plane in which the connecting elements are located, such as the longitudinal axis and/or the transverse axis of the support, and/or an axis transverse to the plane in which the connecting elements are located. The connecting elements may be flexible, and, for example, be implemented as a living hinge. Thus, the connecting elements can be relatively easily formed as a level element enabling both curving about the second bending axis and torsion. It will be clear that the connecting elements may also be implemented as hinge parts, for example hinge parts that can be snapped into each other, such as for example a ball and a bowl. Depending on the point of attachment of the connecting elements, the ends or the central portions of the segments can move substantially freely relative to each other in a direction parallel to the second bending direction. The segments and connecting elements may also be manufactured as one part.

Also, the segments may be connected to each other by way of or near their central portions in a shared connection point. Ends of the segments may be spatially distributed around the connection point. The ends can move substantially freely relative to each other in the tangential direction of a circle around the connection point.

Further, the segments of the carrying dish may be mutually loose with respect to each other. The body part pad may further be provided with a carrying dish chamber. The carrying dish may be received in the carrying dish chamber in a partly form-closed manner, so that the segments lie next to and substantially parallel to each other and to the second bending axis in the carrying dish chamber. The form-closure may be such that ends of the segments can move freely relative to each other at least in a direction parallel to the second bending direction. The form-closure may also be such that central portions of the segments cannot move relative to each other, at least, can move relative to each other considerably less than the ends.

The body part pad may further be provided with a multiplicity of supports spaced apart with a mutual intermediate distance and extending away from an outer side of the carrying dish. The supports may be disposed near an edge or edges of the carrying dish, on both sides of the first bending axis and on at least one side of the second bending axis. The support can exert the opposed forces on the carrying dish. The supports may be provided on the carrying dish.

The body part pad may on an outer side be provided with a supporting cap. The supporting cap may be provided with a carrying dish chamber for receiving therein the carrying dish. The carrying dish chamber in the supporting cap may be the carrying dish chamber of the third embodiment in which the carrying dish is received in a partly form-closed manner. The supports mentioned earlier may be provided on the supporting cap. The supports may be provided on a circumferential edge of the supporting cap around a level central portion of the supporting cap. The supports can have a height such that, in use, on a level base surface, the level central portion of the supporting cap, upon a deflective bending of the carrying dish, does not contact the level base surface. An outer side of the supporting cap may be water-tight or splash water-tight. The supporting cap may be made of EVA (Ethylene Vinyl Acetate) foam. The supporting cap can have a Shore A hardness of between 30 and 40, preferably about 35.

The carrying dish may be made of a hard plastic. The carrying dish may be of thin-walled design. This provides the necessary flexibility of the carrying dish.

The body part pad may on an inner side of the carrying dish be provided with a supporting layer for cooperation with the body part to be protected. The supporting layer can have a Shore A hardness of between 10 and 20, preferably approximately 20. This is softer than the just-mentioned hardness of the supporting cap. The supporting layer as a soft intermediate layer provides for a further damping of any local peak loads, and thereby for an increase of comfort. The supporting layer may, at least in part, be made of neoprene.

It is noted that the above-mentioned measures can be applied to advantage not only in themselves but also in random combinations.

Further elaborations of the invention are described in the dependent claims and will hereinafter be clarified in more detail on the basis of an example, with reference to the figures.

DETAILED DESCRIPTION OF THE FIGURES

Figure 1:
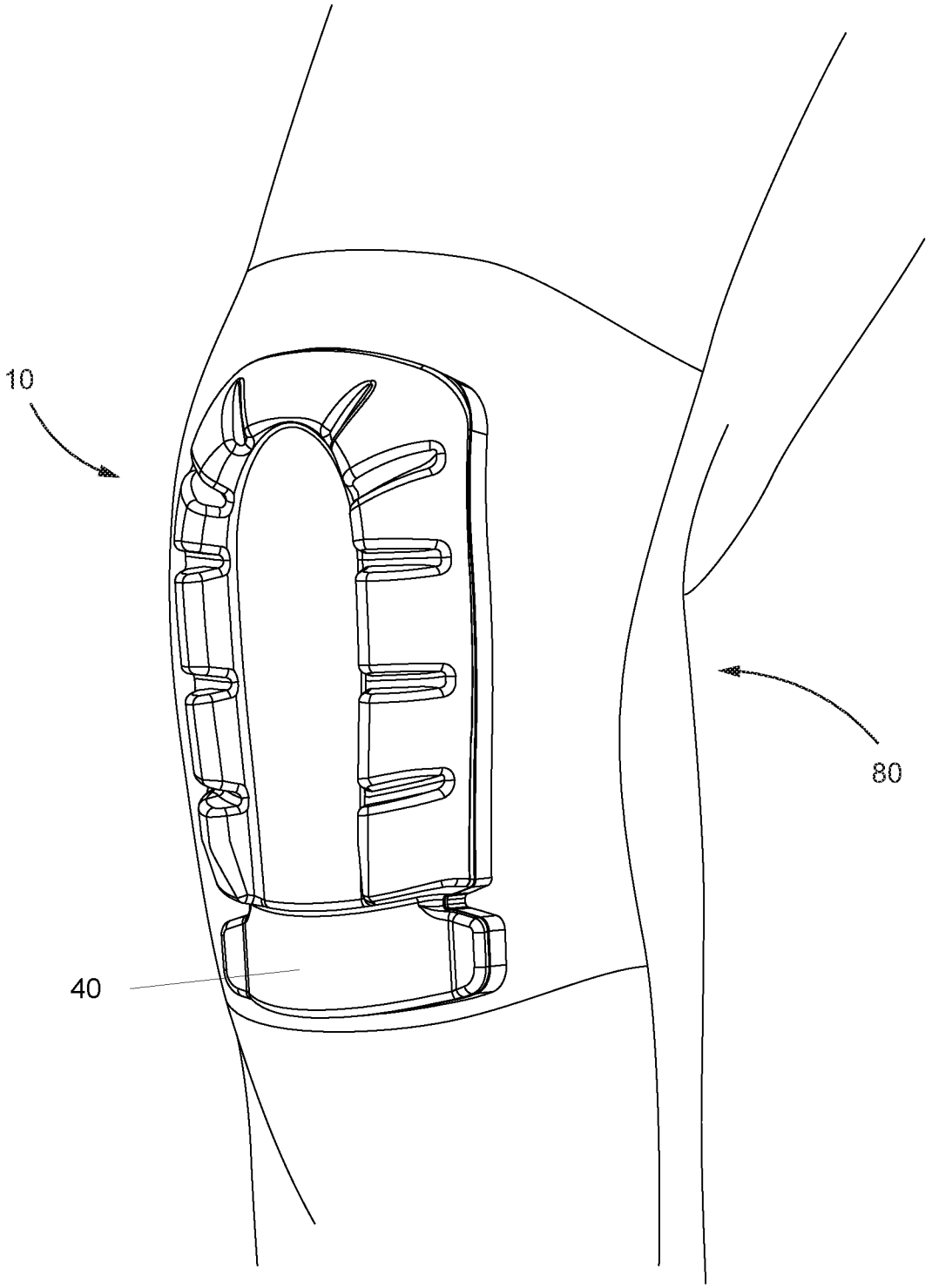
FIG. 1 shows an example of a body part pad according to the invention, in a knee pocket of a pair of trousers.

In the following detailed description of the figures, with the help of reference numerals reference is made to the example that is represented in the figures. The embodiments that are described in the detailed description, however, are not limited to the example that is shown in the figures but may also be implemented in a different manner than is shown in the example. The embodiments described in the detailed description should therefore be read and understood also without the reference numerals. The various embodiments to be described hereinafter can also be used in combination with each other or independently of each other.

Most generally, the invention provides a body part pad 10 for protecting a double curved body part from external load. The body part pad 10 comprises a flexible carrying dish 12, which in a first bending direction 14 is bendable about a first bending axis 16, and which in a second bending direction 18 is bendable about a second bending axis 20. The carrying dish 12 comprises multiple segments 22 of which adjacent segment parts are disposed with an intermediate distance. The intermediate distance of adjacent segment parts 24 upon bending of the carrying dish 12 is variable, at least in the second bending direction 18, so that, in use, a force that is exerted on the carrying dish by the body part 80 and the opposed forces that are exerted on the carrying dish 12 result in curvature of the carrying dish 12 around the first and second bending axis 16, 20 to a curvature more corresponding with the body part 80 to be protected.

The body part pad 10, provided with the above described carrying dish 12, may be implemented as a knee pad, shoulder pad, elbow pad, and/or a heel pad. As a knee pad, the body part pad 10 may be implemented both as an external knee pad, for example provided with a carrying strap, and as an internal knee pad. In this latter case, it is desirable that the body part pad 10 complies with the standards applying for internal knee pads. This concerns especially standards about the size of the knee pocket which the body part pad 10 must fit into. The body part pad 10 implemented as an internal knee pad may be provided with a spacer 40. The position of the knee pocket with respect to the knee to be protected depends on the length of the trouser-leg in which the knee pocket sits and the ratio between the length of the lower leg and the length of the upper leg. This differs from one person to the next. This means that the exact position of the knee pocket with respect to the knee to be protected can differ per person. The spacer 40 can ensure that the second bending axis 20 comes to be at the same height with the bending axis of the knee to be protected, at least, that these bending axes come to be closer to each other than would the case without the spacer 40.

Upon curving of the carrying dish 12, the distance between two points on the carrying dish 12 will change. If, for example, a flat carrying dish 12 is curved around the two bending axes 16, 20, the carrying dish 12 obtains a bent shape whereby the two points come to lie closer to each other. To be able to properly conform to the body part 80 to be protected, the carrying dish 12 must be able to deal with this change in shape/distance. Due to segment parts being disposed with the intermediate distance, there is space between these segment parts. If the carrying dish 12 is curved, and hence the segments 22 are curved, this intermediate distance will be increased or reduced. This enables the carrying dish 12 to properly deal with the change in shape/distance.

The first bending direction 14 may be parallel to a longitudinal axis of the body part pad 10, and the second bending direction 18 may be parallel to a transverse axis of the body part pad 10. With double curved body parts, there is often a first curvature with a first curvature arc involved and a second curvature, substantially perpendicular to the first curvature, with a second curvature arc, the first curvature arc being smaller than the second curvature arc. Examples of such body parts are the knee, the shoulder and the elbow. For instance with the knee, the first curvature arc is perpendicular to the longitudinal direction of the leg, and the second curvature arc is across the knee, parallel to the leg. To offer a proper protection, the body part pad 10 is preferably provided on the body part pad 10 in longitudinal direction parallel to the second curvature arc, with the transverse direction of the body part pad 10 parallel to the first curvature arc of the body part pad 80 to be protected. With the first bending direction 14 of the carrying dish 12 parallel to the longitudinal axis of the body part pad 10, and the second bending direction 18 parallel to the transverse axis of the body part pad 10, an optimum protection is then offered to the body part 80 to be protected.

As mentioned, the above described carrying dish 12 is provided with segments 22 which enable the carrying dish 12, and hence also the body part pad 10, to curve around the two bending axes 16, 20. However, it is not requisite that segments 22 be used for this. Any implementation of the carrying dish 12 that is sufficiently flexible to curve around the body part 80 to be protected, suffices. The carrying dish 12 may also be, for example, a flexible and substantially flat, single curved, or double or multiple curved carrying dish 12. The curvature may be accomplished, for example, by supports 32 on the body part pad, for example the supports 32 described hereinbelow. If these extend from an outer side of the carrying dish 12, that is, away from the body part 80 to be protected, then the supports 32 can furnish the opposite forces to the force exerted by the body part 10 on the carrying dish 12, resulting in the carrying dish 12 being curved.

The other effects and advantages of the body part pad 10 have already been described in the summary and these effects and advantages are considered inserted here by citation.

An interspace between the adjacent segments parts can be free. As a result of the carrying dish 12 curving, the segments parts can be urged towards each other. Due to the intermediate space between these segment parts being free, it is possible for these segment parts to move towards each other. The segments 22 may be substantially single curved. This is to say that they have a curvature that lies in one plane. Such a curvature makes it easier for the carrying dish to curve parallel to that plane and distribute forces over the body part 80 to be protected. Ends 26 of these single curved segments 22 may be flattened. This ensures that the thickness of the carrying dish 12, and hence the body part pad 10, remains limited, without this compromising the possibility for the carrying dish 12 to curve about the body part 80. In consequence of this, the body part pad 10 can remain relatively thin, allowing it to be used also, for example, as an internal knee pad in a knee pocket of a pair of trousers. The segments 22 may be implemented as substantially flat and elongate segments 22. The segments 22 may also be elastic.

Figure 2:
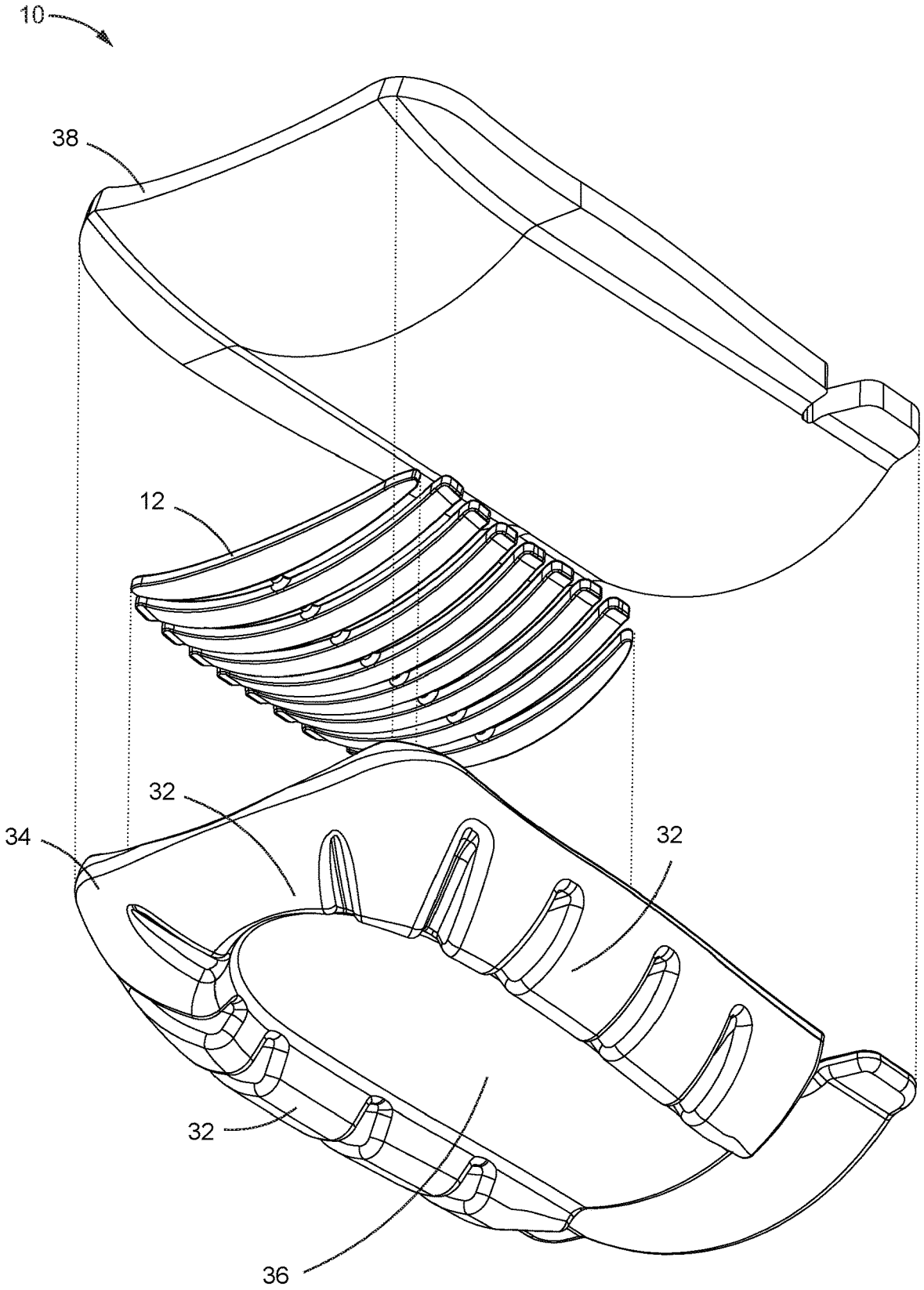
FIG. 2 shows an exploded drawing of the example of FIG. 1.
Figure 3:
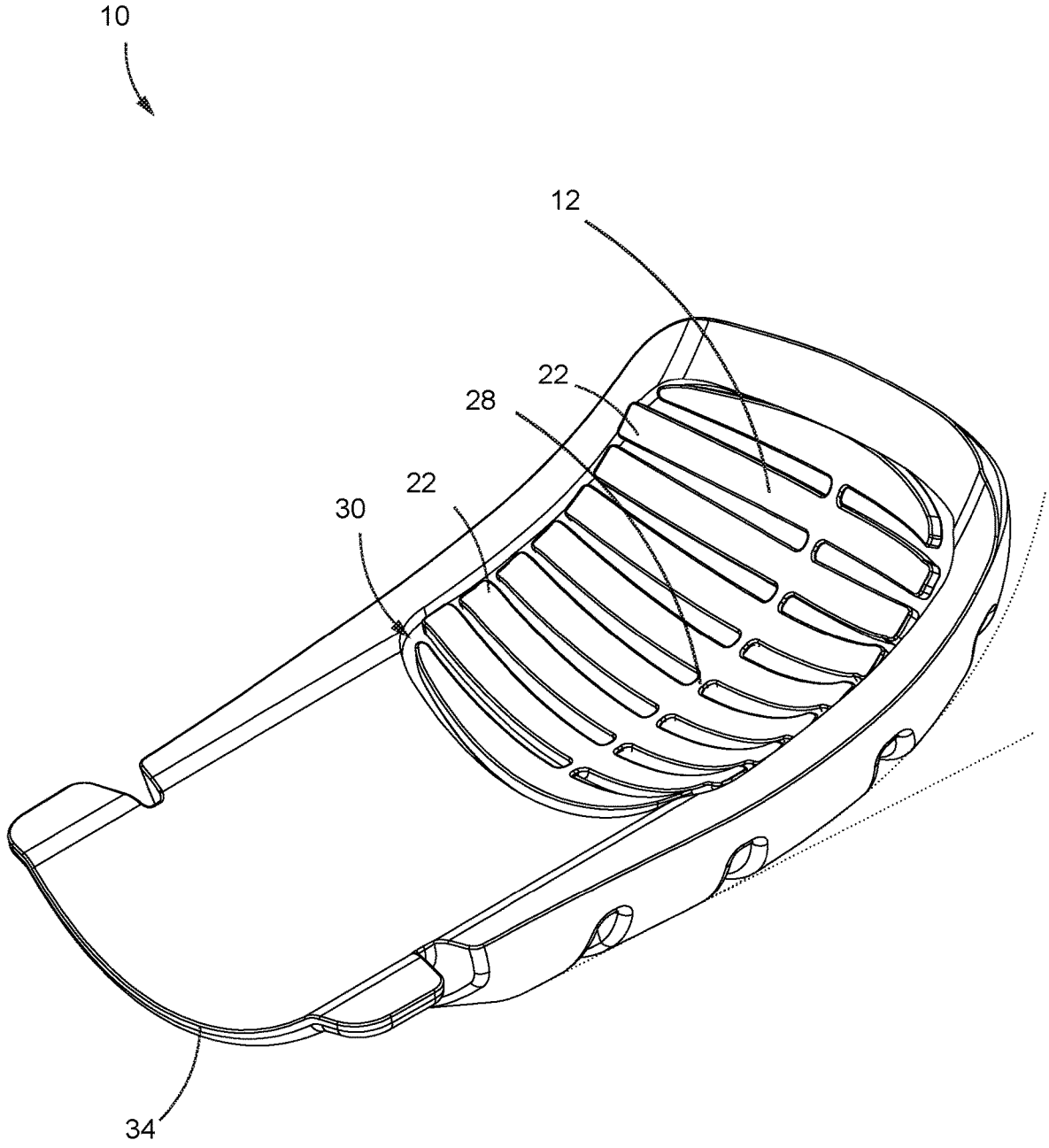
FIG. 3 shows a carrying dish and supporting cap of the example of FIGS. 1 and 2.
Figure 4:
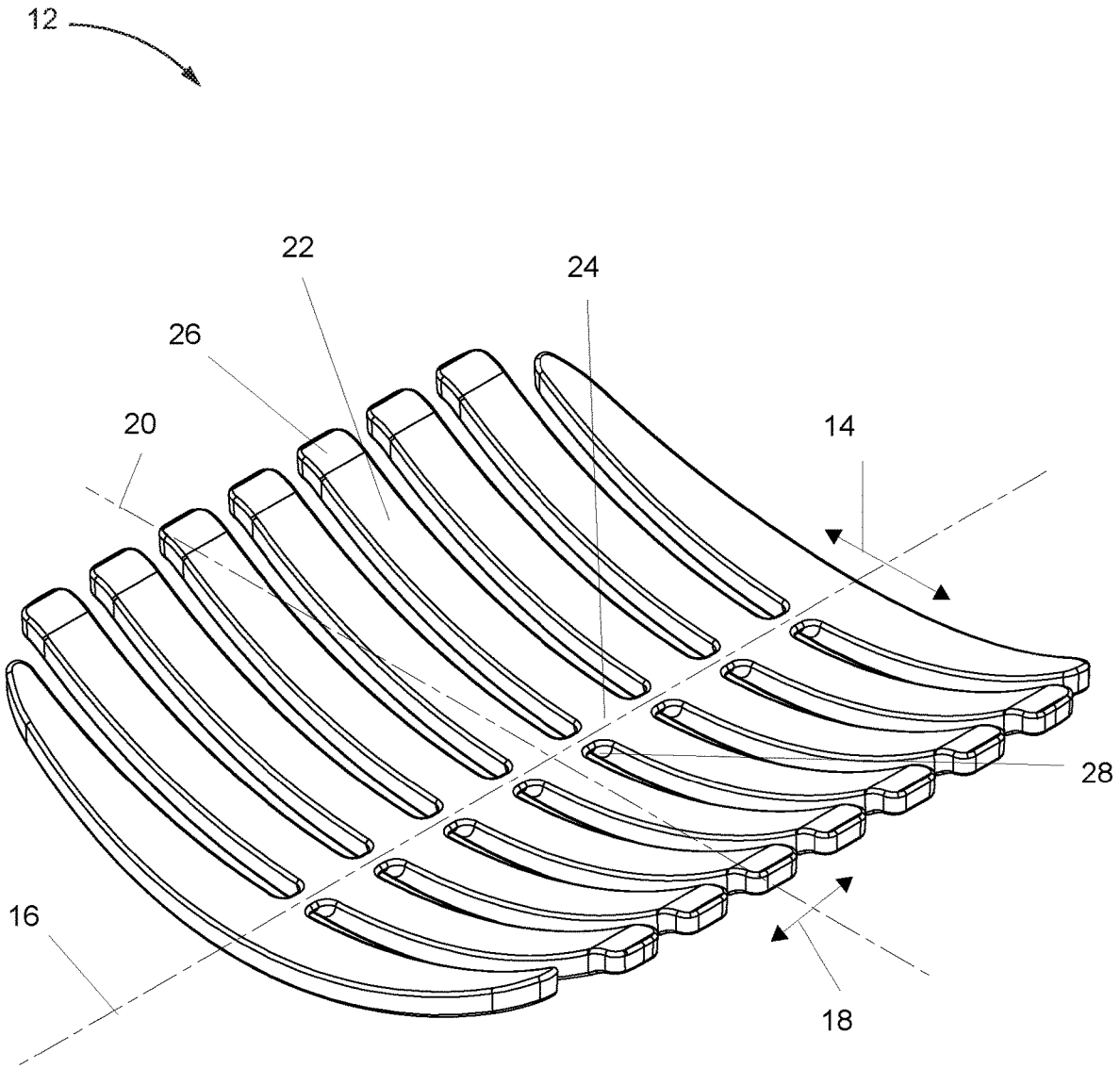
FIG. 4 shows merely the carrying dish of the example of the foregoing figures.
Figure 5:
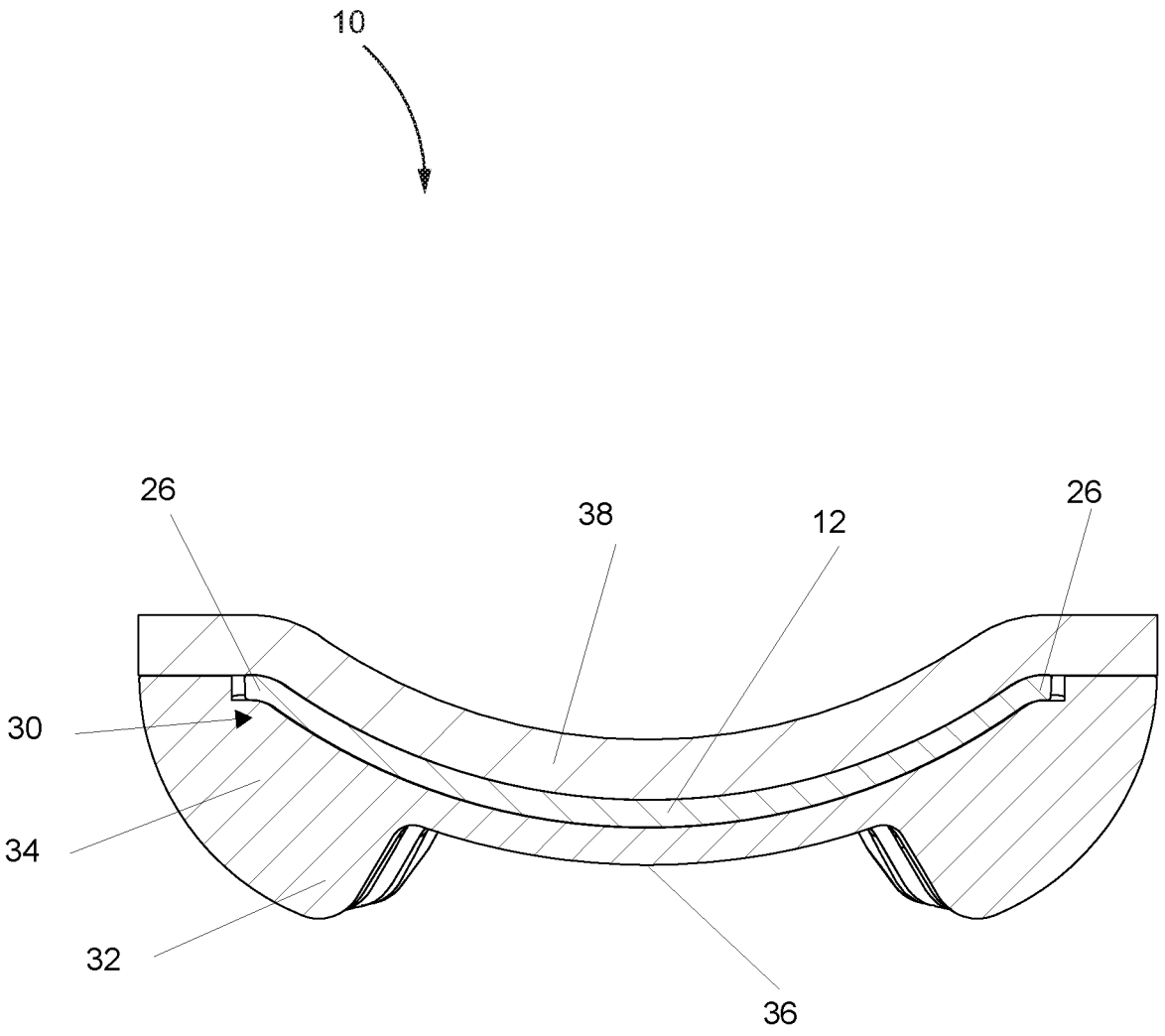
FIG. 5 shows a lateral cross section of the example of FIG. 1.

In a first embodiment, of which an example is shown in the FIGS. 1-5, the segments 22 are connected with each other by or near a central portion 24. The segments 22 may be disposed next to and parallel to each other and substantially parallel to the second bending axis 20, with the central portions 24 of two successive segments 22 being connected by means of a connecting element 28. The connecting elements 28 may be flexible and enable a curving about the second bending axis 20. Ends 26 of the segments 22 can move substantially freely relative to each other in a direction parallel to the second bending direction 18. The segments 22 and connecting elements 28 may be manufactured as one part.

Through bending of the segments, the carrying dish 12 can curve around the first bending axis 16. By means of the flexible connecting elements 28, the carrying dish 12 can curve around the second bending axis 20. Due to the ends 26 being able to move relative to each other and these parts being disposed with an intermediate distance, the carrying dish 12 is able to have both curvatures at the same time. The flexible connecting elements 28 also ensure that the carrying dish 12 can curve at different places, namely at each connecting element 28. The second bending axis 20 is not uniformly fixed, but can form at different points, depending on the shape and place of depression of the body part 80 to be protected in the body part pad 10. This means that there is no one relative position of the body part pad 10 with respect to the body part 80 to be protected in which the body part pad 10 works well, but that there are several relative positions where the body part pad 10 protects the body part 80 to-be-protected well and comfortably.

In a second embodiment, the segments 22 may be connected to each other by or near their central portions 24 in a joint connecting point. Ends 26 of the segments 22 may be spatially distributed around the connecting point. The ends 26 can move substantially freely relative to each other in the tangential direction of a circle around the connecting point.

The segments 22 in this way form a kind of star or spider. The ends can move relative to each other and curve around the body part pad 80 to be protected.

In a third embodiment, the segments 22 of the carrying dish 12 may be mutually loose from each other. The body part pad 10 may further be provided with a carrying dish chamber 30. The carrying dish 12 may be received in the carrying dish chamber 30 in a partly form-closed manner, so that the segments 22 sit in the carrying dish chamber 30 next to and substantially parallel to each other and to the second bending axis 20. The form closure may be such that ends 26 of the segments 22 can move freely relative to each other at least in a direction parallel to the second bending direction 18. The form closure may also be such that central portions 24 of the segments 22 cannot move relative to each other, at least can move relative to each other considerably less than the ends 26.

For all the embodiments described here, it holds that the body part pad 10 may further be provided with a multiplicity of supports 32 spaced apart with a mutual intermediate distance and extending away from an outer side of the carrying dish 12. An example of this is shown in the figures. The supports 32 may be provided on the carrying dish 12, but also placement on other parts of the body part pad 10 is possible. An example of placement on a supporting cap 34 is shown in the figures. This supporting cap 34 may be the supporting cap 34 described hereinbelow. The supports 32 may be disposed near en edge or edges of the carrying dish 12, on both sides of the first bending axis 16 and on at least one side of the second bending axis 20. The supports 32 can exert the opposed forces on the carrying dish. Together with the force exerted by the body part 80 to be protected, these forces cause the carrying dish to be curved around the first and second bending axis 16, 20.

For all the embodiments described here, it also holds that the body part pad 10 on an outside thereof may be provided with a supporting cap 34, of which an example is shown in the figures. The supporting cap 34 may be provided with a carrying dish chamber 30 for receiving therein the carrying dish 12. The carrying dish chamber 30 in the supporting cap 34 may be the above-described carrying dish chamber 30 in which the carrying dish 12 is received in a partly form-closed manner. The above-mentioned supports 32 may be provided on the supporting cap 34. The supports 32 may be provided on or to a circumferential edge of the supporting cap 34 around a level central portion 36 of the supporting cap 34. The supports 32 may have a height such that, in use, on a level base surface, the level central portion 36 of the supporting cap 34 upon a deflective bending of the carrying dish 12 does not contact the level base surface. As a result, it is merely the supports that furnish the opposed forces that, together with the force exerted by the body part 80, cause the carrying dish 12 to curve. An outer side of the supporting cap 34 may be watertight or splash water-tight. The supporting cap 34 may be made of EVA (Ethylene Vinyl Acetate) foam. That material is wear-resistant and watertight. The supporting cap 34 can have a Shore A hardness of between 30 and 40, preferably about 35.

For all the embodiments described here, it holds that the carrying dish 12 may be made of a hard plastic. Examples of this are nylon-6, or nylon-66. The carrying dish 12 may be of thin-walled design. The thickness of the carrying dish 12 can be, for example, between 0.5 and 5 mm, preferably about 2.4 mm. The relation between a stiffness of the material used and the thickness of the carrying dish 12 may be strictly descendant, that is, the thickness decreases if the stiffness increases and the other way around. This relation may be, for example, inversely proportional. These properties provide the necessary flexibility of the carrying dish 12.

For all the embodiments described here, it holds that the body part pad 10, on an inner side of the carrying dish 12, is provided with a supporting layer 38 for cooperation with the body part to be protected. The supporting layer 38 can have a Shore A hardness of between 10 and 20, preferably about 20. This is softer than the above-mentioned hardness of the supporting cap 34. The supporting layer 38 as a soft intermediate layer provides for a further damping of any local peak loads, and hence for an increase of comfort. The supporting layer 38 may, at least in part, be made of neoprene.

The invention is not limited to the example shown in the figures. The above described embodiments, as already indicated, may also be implemented differently than shown in the example of the figures. The scope of protection is defined by the appended claims, in which the reference numerals have no limiting effect.

KEY TO REFERENCE NUMERALS

10—body part pad
12—carrying dish
14—first bending direction
16—first bending axis
18—second bending direction
20—second bending axis
22—segment
24—central portion of a segment
26—end of a segment
28—connecting element
30—carrying dish chamber
32—supports
34—supporting cap
36—level central portion
38—supporting layer
40—spacer
80—body part

The invention claimed is:

1. Body part pad for protecting a double curved body part from an external load, the body part pad comprising:

a flexible carrying dish, which in a first bending direction is bendable about a first bending axis, and which in a second bending direction is bendable about a second bending axis;

wherein the carrying dish comprises a multiplicity of segments of which adjacent segment parts are disposed with an intermediate distance, and wherein the intermediate distance of adjacent segment parts is variable upon bending of the carrying dish in the second bending direction, so that, in use, a force that is exerted by the body part on an inner side of the carrying dish and opposed forces that are exerted on an outer side of the carrying dish by the external load from which the body part is to be protected result in curvature of the carrying dish around the first and second bending axis to a curvature corresponding more with the body part to be protected;

a supporting cap arranged on the outer side of the carrying dish;

wherein the supporting cap has a multiplicity of supports arranged thereon for transmitting the opposed forces from the external load from which the body part is to be protected onto the outer side of the carrying dish, wherein the supports are spaced apart with a mutual intermediate distance, and wherein the supports are provided at least near to a circumferential edge of the supporting cap, on both sides of the first bending axis and on at least one side of the second bending axis.

2. The body part pad according to claim 1, wherein the body part pad is implemented as a bowl-shaped body part pad.

3. The body part pad according to claim 1, wherein the segments are substantially single curved.

4. The body part pad according to claim 1, wherein the segments are implemented as substantially flat and elongate segments.

5. The body part pad according to claim 1, wherein the segments are connected to each other at least near a central portion.

6. The body part pad according to claim 5, wherein the segments are connected to each other with a central portion.

7. The body part pad according to claim 1, wherein adjacent segments are connected by means of a connecting element.

8. The body part pad according to claim 1, wherein an outer side of the supporting cap is watertight or splash water-tight.

9. The body part pad according to claim 1, wherein the supporting cap is made of EVA (Ethylene Vinyl Acetate) foam, wherein the body part pad has a supporting layer for cooperation with the body part to be protected, wherein the supporting layer is arranged on the inner side of the carrying dish, and wherein the supporting layer, at least partly, is made of neoprene.

10. The body part pad according to claim 1, wherein the supporting cap has a Shore A hardness of between 30 and 40.

11. The body part pad according to claim 1, wherein the body part pad has a supporting layer for cooperation with the body part to be protected and wherein the supporting layer is arranged on the inner side of the carrying dish.

12. The body part pad according to claim 11, wherein the supporting layer has a Shore A hardness of between 10 and 20.

13. The body part pad according to claim 1, implemented as a knee pad.

14. The body part pad according to claim 1, wherein the supports are provided on the circumferential edge of the supporting cap, on both sides of the first bending axis and on at least one side of the second bending axis.

15. Body part pad for protecting a double curved body part from an external load, the body part pad comprising:

a flexible carrying dish, which in a first bending direction is bendable about a first bending axis, and which in a second bending direction is bendable about a second bending axis;

wherein the carrying dish comprises a multiplicity of segments of which adjacent segment parts are disposed with an intermediate distance, and wherein the intermediate distance of adjacent segment parts is variable upon bending of the carrying dish in the second bending direction, so that, in use, a force that is exerted by the body part on an inner side of the carrying dish and opposed forces that are exerted on an outer side of the carrying dish by the external load from which the body part is to be protected result in curvature of the carrying dish around the first and second bending axis to a curvature corresponding more with the body part to be protected, wherein the carrying dish has a multiplicity of supports arranged thereon for transmitting the opposed forces from the external load from which the body part is to be protected onto the outer side of the carrying dish, wherein the supports are spaced apart with a mutual intermediate distance, wherein the supports are arranged on the outer side of the carrying dish, and wherein the supports are disposed near at least one edge or edges of the carrying dish, on both sides of the first bending axis and on at least one side of the second bending axis.

16. The body part pad according to claim 15, wherein the segments are substantially single curved.

17. The body part pad according to claim 15, wherein the segments are implemented as substantially flat and elongate segments.

18. The body part pad according to claim 15, wherein the segments are connected to each other at least near a central portion.

19. The body part pad according to claim 18, wherein the segments are connected to each other with a central portion.

20. The body part pad according to claim 15, wherein adjacent segments are connected by means of a connecting element.

21. The body part pad according to claim 15, wherein the body part pad is implemented as a bowl-shaped body part pad.

22. The body part pad according to claim 15, implemented as a knee pad.

23. The body part pad according to claim 15, wherein the supports are disposed near edges of the carrying dish, on both sides of the first bending axis and on at least one side of the second bending axis.

* * * * *